US007928333B2

(12) United States Patent
Wang et al.

(10) Patent No.: US 7,928,333 B2
(45) Date of Patent: Apr. 19, 2011

(54) SWITCH STRUCTURES

(75) Inventors: Xuefeng Wang, Schenectady, NY (US); Marco Francesco Aimi, Niskayuna, NY (US); Shubhra Bansal, Niskayuna, NY (US); Christopher Fred Keimel, Schenectady, NY (US); Kuna Venkat Satya Rama Kishore, Karnataka (IN); Kanakasabapathi Subramanian, Clifton Park, NY (US)

(73) Assignee: General Electric Company, Niskayuna, NY (US)

( * ) Notice: Subject to any disclaimer, the term of this patent is extended or adjusted under 35 U.S.C. 154(b) by 62 days.

(21) Appl. No.: 12/541,321

(22) Filed: Aug. 14, 2009

(65) Prior Publication Data

US 2011/0036690 A1 Feb. 17, 2011

(51) Int. Cl.
*H01H 57/00* (2006.01)

(52) U.S. Cl. ..... 200/181; 335/78

(58) Field of Classification Search ..... 200/181; 361/78, 233

See application file for complete search history.

(56) References Cited

U.S. PATENT DOCUMENTS

| | | | | |
|---|---|---|---|---|
| 4,264,798 | A | 4/1981 | Graf | |
| 6,441,405 | B1 | 8/2002 | Smith | |
| 7,002,527 | B2 * | 2/2006 | Sugawara | 343/750 |
| 2004/0017644 | A1 * | 1/2004 | Goodwin-Johansson | 361/233 |
| 2008/0013538 | A1 | 1/2008 | Lee et al. | |
| 2008/0149869 | A1 * | 6/2008 | Shannon et al. | 251/129.01 |
| 2009/0284823 | A1 * | 11/2009 | Chen et al. | 359/290 |
| 2010/0096678 | A1 * | 4/2010 | Subramanyam | 257/295 |
| 2010/0252403 | A1 * | 10/2010 | Hays et al. | 200/181 |

FOREIGN PATENT DOCUMENTS

JP 2003242850 A1 8/2003

OTHER PUBLICATIONS

Germer, "Electrical Breakdown Between Close Electrodes in Air", Journal of Applied Physics, vol. 30, No. 1, pp. 46-51, Jan. 1959.

Slade et al., "Electrical Breakdown in Atmospheric Air Between Closely Spaced (0.2 μm-40 μm) Electrical Contacts", IEEE Transactions on Components and Packaging Technologies, vol. 25, No. 3, pp. 390-396, Sep. 2002.

Majumder et al., "Adhesion and Contact Resistance in an Electrostatic MEMS Microswitch", Micro Electro Mechanical Systems, 18th IEEE International Conference, pp. 215-218, Jan. 30-Feb. 3, 2005.

* cited by examiner

*Primary Examiner* — Michael A Friedhofer
(74) *Attorney, Agent, or Firm* — Richard D. Emery

(57) ABSTRACT

A device, such as a switch structure, is provided, the device including a contact and a conductive element. The conductive element can be configured to be selectively moveable between a non-contacting position, in which the conductive element is separated from the contact (in some cases by a distance less than or equal to about 4 μm, and in others by less than or equal to about 1 μm), and a contacting position, in which the conductive element contacts and establishes electrical communication with the contact. When the conductive element is disposed in the non-contacting position, the contact and the conductive element can be configured to support an electric field therebetween with a magnitude of greater than 320 V $\mu m^{-1}$ and/or a potential difference of about 330 V or more.

46 Claims, 4 Drawing Sheets

SWITCH STRUCTURES

BACKGROUND

Embodiments of the invention relate generally to devices for switching current, and more particularly to microelectromechanical switch structures.

A circuit breaker is an electrical device designed to protect electrical equipment from damage caused by faults in the circuit. Traditionally, many conventional circuit breakers include bulky (macro-)electromechanical switches. Unfortunately, these conventional circuit breakers are large in size may necessitate use of a large force to activate the switching mechanism. Additionally, the switches of these circuit breakers generally operate at relatively slow speeds. Furthermore, these circuit breakers can be complex to build and thus expensive to fabricate. In addition, when contacts of the switching mechanism in conventional circuit breakers are physically separated, an arc can sometimes form therebetween, which arc allows current to continue to flow through the switch until the current in the circuit ceases. Moreover, energy associated with the arc may seriously damage the contacts and/or present a burn hazard to personnel.

As an alternative to slow electromechanical switches, relatively fast solid-state switches have been employed in high speed switching applications. These solid-state switches switch between a conducting state and a non-conducting state through controlled application of a voltage or bias. However, since solid-state switches do not create a physical gap between contacts when they are switched into a non-conducting state, they experience leakage current when nominally non-conducting. Furthermore, solid-state switches operating in a conducting state experience a voltage drop due to internal resistances. Both the voltage drop and leakage current contribute to power dissipation and the generation of excess heat under normal operating circumstances, which may be detrimental to switch performance and life. Moreover, due at least in part to the inherent leakage current associated with solid-state switches, their use in circuit breaker applications is not possible.

Micro-electromechanical system (MEMS) based switching devices may provide a useful alternative to the macro-electromechanical switches and solid-state switches described above for certain current switching applications. MEMS-based switches tend to have a low resistance when set to conduct current, and low (or no) leakage when set to interrupt the flow of current therethrough. Further, MEMS-based switches are expected to exhibit faster response times than macro-electromechanical switches.

BRIEF DESCRIPTION

In a first aspect, a device, such as a switch structure, is provided, the device including a contact and a conductive element, in some cases disposed on a substrate. The conductive element can be configured to be selectively moveable between a non-contacting position, in which the conductive element is separated from the contact (e.g., by a distance less than or equal to about 4 μm, and in some cases by less than or equal to about 1 μm), and a contacting position, in which the conductive element contacts and establishes electrical communication with the contact. When the conductive element is disposed in the non-contacting position, the contact and the conductive element can be configured to support an electric field therebetween with a magnitude of greater than 320 V $\mu m^{-1}$, for example, due to a potential difference therebetween of at least about 330 V.

In some embodiments, the contact and conductive element may be part of a microelectromechanical device, and the conductive element can have a surface area-to-volume ratio that is greater than or equal to $10^3$ $m^{-1}$. The conductive element may be configured to undergo deformation when moving between the contacting and non-contacting positions. The conductive element may include a cantilever. At least one of the contact or the conductive element can have an effective contact surface area (e.g., less than or equal to about 100 $\mu m^2$) configured such that an electrostatic force between the contact and the conductive element when the conductive element is in the non-contacting position is less than a force required to bring the conductive element and the contact into contact.

In some embodiments, the contact and the conductive element may be configured to limit current therebetween to about 1 μA or less when the conductive element is disposed in the non-contacting position. In some embodiments, when the conductive element is disposed in the non-contacting position, the contact and the conductive element may be configured to be held at a potential difference that oscillates with an amplitude of at least about 330 V and with a frequency of less than or equal to about 40 GHz, or at a potential difference of at least about 330 V for a time of at least about 1 μs.

In some embodiments, the device may include a power source in electrical communication with at least one of the contact or the conductive element and configured to supply a voltage of at least about 330 V. The power source may be configured to supply a current of at least about 1 mA when the conductive element is disposed in the contacting position.

In another aspect, a device, such as a switch structure, is provided, the device including a contact and a conductive element. The conductive element can be configured to be selectively moveable between a non-contacting position, in which the conductive element is separated from the contact, and a contacting position, in which the conductive element contacts and establishes electrical communication with the contact. When the conductive element is disposed in the non-contacting position, the contact and the conductive element can be configured to be held at a potential difference of at least about 330 V.

DRAWINGS

These and other features, aspects, and advantages of the present invention will become better understood when the following detailed description is read with reference to the accompanying drawings in which like characters represent like parts throughout the drawings, wherein.

DETAILED DESCRIPTION

Figure 1:
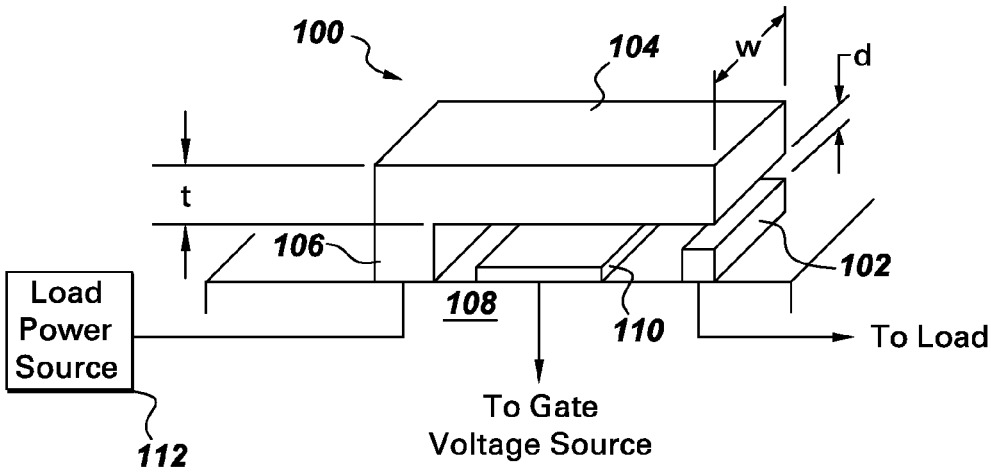
FIG. 1 is a schematic perspective view of a switch structure configured in accordance with an example embodiment.

Example embodiments of the present invention are described below in detail with reference to the accompanying drawings, where the same reference numerals denote the same parts throughout the drawings. Some of these embodiments may address the above and other needs.

Figure 2:
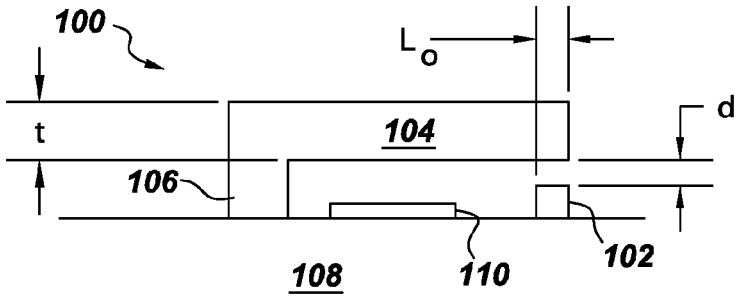
FIG. 2 is a schematic side view of the switch structure of FIG. 1.
Figure 3:
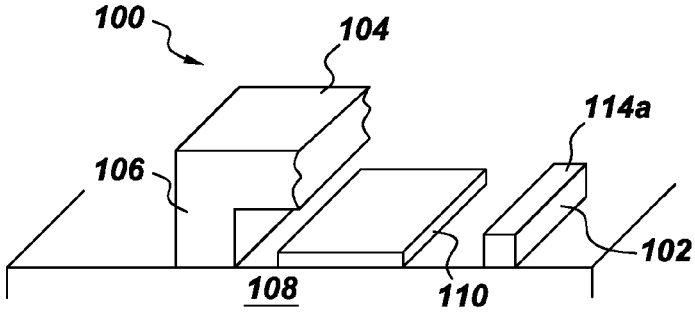
FIG. 3 is a schematic fragmentary perspective view of the switch structure of FIG. 1.
Figure 4:
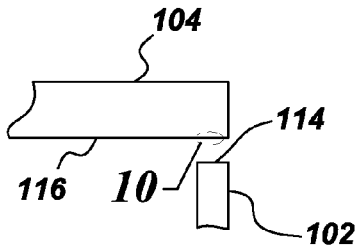
FIG. 4 is a schematic side view of the switch structure of FIG. 1 in an open position.
Figure 5:
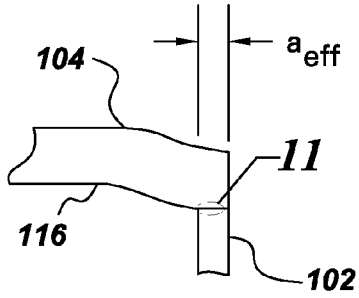
FIG. 5 is a schematic side view of the switch structure of FIG. 1 in a closed position.
Figure 6A:
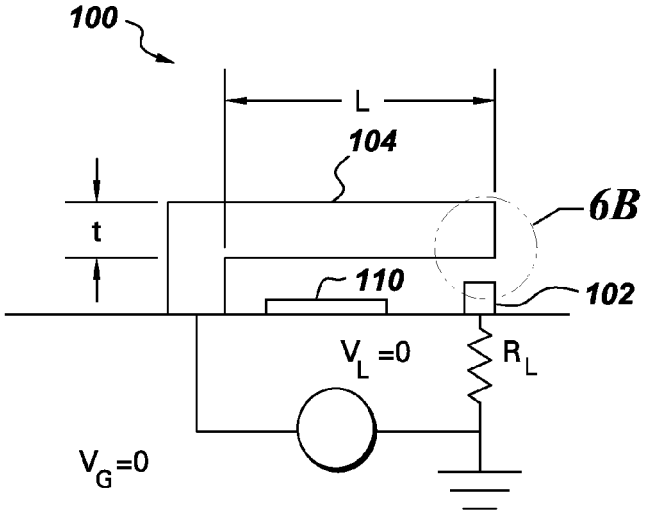
FIG. 6A is a schematic side view of the switch structure of FIG. 1, the switch structure including a beam and contact that are held at equal potential.
Figure 6B:
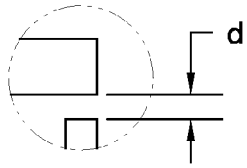
FIG. 6B is a magnified view of the area labeled 6B in FIG. 6A.
Figure 7A:
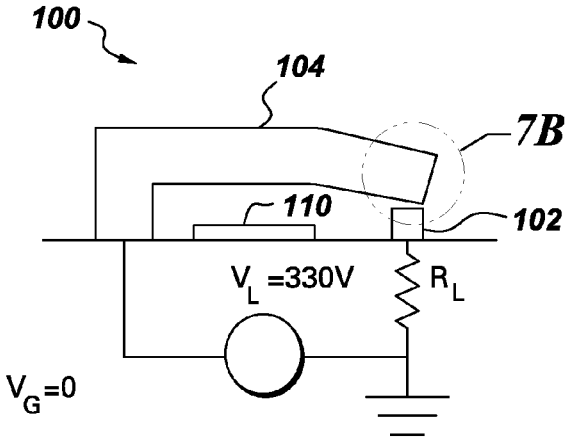
FIG. 7A is a schematic side view of the switch structure of FIG. 1, with the beam and contact being held at respectively different potentials.
Figure 7B:
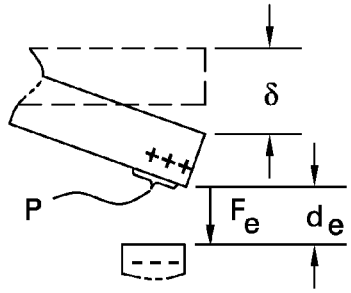
FIG. 7B is a magnified view of the area labeled 7B in FIG. 7A.

Referring to FIGS. 1-3, therein are shown several schematic views of a switch structure 100 configured in accordance with an example embodiment. The switch structure 100 can include a contact 102, which may be, for example, a raised pad formed, at least partially, of a conductive material (e.g., metal). The switch structure 100 can also include a conductive element, such as a cantilevered beam 104, formed at least partially of conductive material (e.g., metal). The beam 104 can be supported by an anchor 106, which may serve to connect the beam to an underlying support structure, such as a substrate 108. The contact 102 may also be supported by the substrate 108.

Disposing the contact 102 and beam 104 on a substrate 108 facilitates the production of the switch structure 100 through microfabrication techniques (e.g., vapor deposition, electroplating, photolithography, wet and dry etching, etc.). Along these lines, the switch structure 100 may constitute a portion of a microelectromechanical device or MEMS. For example, the contact 102 and beam 104 may have features on the order of ones or tens of micrometers or nanometers. In one embodiment, the beam 104 may have a surface area-to-volume ratio that is greater than or equal to $10^3$ $m^{-1}$. Details regarding possible methods for fabricating the switch structure 100 are discussed further below. The substrate 108 may also include or support patterned conductive layers (not shown) that serve to provide electrical connections to the contact 102 and beam 104. These conductive layers can also be fabricated using standard microfabrication techniques.

Referring to FIGS. 1-5, the beam 104 can be configured to be selectively moveable between a non-contacting or "open" position (e.g., FIG. 4), in which the beam is separated from the contact 102, and a contacting or "closed" position (e.g., FIG. 5), in which the beam contacts and establishes electrical communication with the contact. For example, the beam 104 can be configured to undergo deformation when moving between the contacting and non-contacting positions, such that the beam is naturally disposed (i.e., in the absence of externally applied forces) in the non-contacting position and may be deformed so as to occupy the contacting position. In other embodiments, the undeformed configuration of the beam 104 may be the contacting position. The beam 104 may include a surface 116, all of which may be capable of being electrically contacted (e.g., where the surface is a nominally continuous metal plane). However, the "effective" contact surface area $a_{eff}$ can be significantly smaller than the surface 116 of the beam 104, and will tend to be defined by the extent of overlap between the beam and the contact 102.

The beam 104 may be in communication (e.g., via the anchor 106) with a load power source 112, and the contact 102 may be in communication with an electrical load (and, subsequently, ground or some other current sink). The load power source 112 may be operated at different times as a voltage source and a current source. As such, the beam 104 may act as an electrical switch, allowing a load current (say, greater than or equal to about 1 mA) to flow from the load power source 112 through the beam and the contact 102 and to the electrical load when the beam is in the contacting position, and otherwise disrupting the electrical path and preventing the flow of a significant current from the load power source to the load when the beam is in the non-contacting position (although, in some cases, a small leakage current of 1 μA of less may flow through the contact and beam even when the beam is in the open position).

The switch structure 100 may also include an electrode 110. When the electrode 110 is appropriately charged, such that a potential difference exists between the electrode and the beam 104, an electrostatic force will act to pull the beam towards the electrode (and also toward the contact 102). By appropriately choosing the voltage to be applied to the electrode 110, the beam 104 can be deformed by the resulting electrostatic force (possibly in conjunction with another force, such as a complementary mechanical force imparted by a spring) sufficiently to move the beam from the non-contacting (i.e., open or non-conducting, other than a relatively small leakage current that may be present) position to the contacting (i.e., closed or conducting) position. Therefore, the electrode 110 may act as a "gate" with respect to the switch structure 100, with voltages applied to the electrode serving to control the opening/closing of the switch structure. The electrode 110 may be in communication with a gate voltage source (not shown), which gate voltage source may apply a selective gate voltage $V_G$ to the electrode.

The contact 102 and the beam 104 can be configured to be separated by a distance d that is less than or equal to about 4 μm when the beam is in the non-contacting position, and in some embodiments less than or equal to about 1 μm. That is, when in an undeformed configuration, the beam 104 may be consistently held at a distance of 4 μm or less, and sometimes 1 μm or less, from the contact 102 (as opposed to a switch that may, at some instantaneous moment during a switching event, occupy a position 4 μm or less from a corresponding contact, but which is otherwise more consistently disposed a greater distance away from the contact). The contact 102 and the beam 104 may further be configured to be separated by a distance d that is greater than or equal to about 100 nm when the beam is in the non-contacting position.

The load power source 112 may selectively provide a load voltage $V_L$ that is sufficient to establish an electric field between the contact 102 and the beam 104 with a magnitude of greater than 320 V $\mu m^{-1}$ and/or a relative potential difference of at least 330 V. For example, the contact 102 and the beam 104 may be configured to be held for more than a transient period at a relative potential difference of at least 320 V and to be separated by a distance of 1 μm or less, or sometimes a relative potential difference of at least 330 V and a separation distance of 4 μm or less. In some embodiments, when the beam 104 is disposed in the non-contacting position, the contact 102 and the beam may be configured to be held at a potential difference that oscillates with an amplitude of at least about 330 V and with a frequency of less than or equal to about 40 GHz. In other embodiments, when the beam 104 is disposed in the non-contacting position, the contact 102 and the beam may be configured to be held at a potential difference of at least about 330 V for a time of at least about 1 μs. In either case, the beam 104 and the contact 102 can be configured to withstand a relative potential difference that is present for more than just a trivial amount of time.

Applicants have discovered that maintaining a separation distance d of less than or about equal to 4 μm, but usually greater than about 50 nm, between the beam 104 (or other moveable conductive element), when in the non-contacting position, and the contact 102 tends to inhibit electrical arc formation between the beam and contact in an environment of air at atmospheric pressure, even for potential differences between the beam and contact of 330 V or more. This is in contrast to the accepted notion that opposing micron-scale switch components subjected to an electric field of 320 V $\mu m^{-1}$ or more, or to a potential difference of 330 V or more, and separated by distances on the order of 4 μm or less (but greater than about 50 nm or so), will tend to form an arc therebetween. Specifically, it is generally expected that such a configuration of differently-charged and closely-spaced switch components, for example, those components formed through conventional microfabrication methods including electroplating, vapor deposition, and photolithography, will result in breakdown of the space between the components, for example, due to ionization of the gas particles in the area between the bodies and/or emission of electrons from at least one of the bodies due to the influence of the prevailing electric field. For separation distances of about 50 nm or less, field emission effects might be expected to dominate the overall electrical behavior of the device.

As mentioned earlier, establishing a potential difference between the electrode 110 and the beam 104 results in an electrostatic force between the beam and electrode. Similarly, when a potential difference exists between the contact 102 and the beam 104 (e.g., when the beam is in the non-contacting position and $V_L>0$), an electrostatic force $F_e$ will attract the beam to the contact (this phenomenon is referred to herein as "self-actuation").

As an example, referring to FIGS. 1, 6A, 6B, 7A, and 7B, the switch structure 100 can act as a switch between the load power source 112, which may be configured to provide a selective voltage $V_L$ and load current $I_L$ (when part of a complete circuit), and a load, represented by $R_L$. At one time (represented by FIGS. 6A-B), the gate voltage $V_G$ can be set to zero (e.g., when the beam 104 is intended to occupy the non-contacting position) and $V_L$ can be set to zero, such that the contact 102 and beam are at equal potential. In this case, the beam 104 is separated from the contact 102 by a distance d.

At another time (represented by FIGS. 7A-B), $V_G$ is still zero, and the load power source 112 supplies a voltage $V_L$=330 V. The contact 102 and beam 104 are now at different potentials with respect to one another. As a consequence, charges of opposing polarity respectively accumulate at the surface 114 of the contact 102 and at a portion p of the surface of the beam 104 that opposes the contact surface 114. An electrostatic force $F_e$ is established that acts to attract the contact 102 and beam 104 together, and the beam is displaced by a distance δ relative to its natural configuration (i.e., its configuration in the absence of $F_e$). Assuming the contact 102 deforms very little under the influence of $F_e$, the beam 104 is then separated from the contact by a distance $d_e$=d−δ. Applicants have observed that self-actuation can, in some cases, be sufficient to cause an unintended closing of a switch, this amounting to a failure of the switch. Self-actuation must therefore be considered when designing switch structures. This is discussed further below.

Treating the contact 102 and beam 104 as a parallel plate capacitor, basic electrostatic theory suggests that the magnitude of the electrostatic force $F_e$ between the two is proportional to the square of the potential difference V between the contact and the beam, inversely proportional to the square of the distance $d_e$ separating the contact and beam, and proportional to the area A over which the contact and beam are opposing, and is given roughly by:

$$F_e \approx \frac{\varepsilon_0 A V^2}{2d_e^2} \tag{1}$$

where $\in_0$ is the dielectric constant of air. Assuming the overlap area A includes the entire width w (FIG. 1) of the beam 104, the overlap area A would simply be the length $L_o$ (FIG. 2) over which the beam and contact 102 overlap multiplied by the width w. Given the large load voltage $V_L$ (in some cases ≧330 V or more) being held off by the switch structure 100 in some instances, as well as the small separation distance d between the contact 102 and the beam 104 (and the even smaller separation distance $d_e$ in the presence of the electrostatic force $F_e$), $F_e$ has the potential to be relatively high and, potentially, sufficient to bring the beam into contact with the contact. In embodiments for which the gate voltage $V_G$ on the electrode 110 is intended to unilaterally determine whether the switch structure 100 is open or closed, the force $F_e$ must be taken into consideration in designing the switch structure in order to assure that unintended switch closing due to the influence of $F_e$ is avoided. Specifically, in order to avoid an inadvertent closing of switch structure 100 due to self-actuation, the beam 104 and contact 102 must be designed such that the attractive force $F_e$ (which, as discussed below, is related to, amongst other things, the area a of the contact) causes a deflection of the beam that is smaller than its natural separation distance from the contact. This is discussed in more detail below.

If we assume that the electrostatic force $F_e$ is applied at the free end of the beam 104 and that very little deformation occurs in the anchor 106, basic beam theory indicates that the amount of deflection δ of the beam 104 due to $F_e$ is given approximately by:

$$\delta \approx \frac{F_e L^3}{3EI} \tag{2}$$

where E is the elastic modulus of the material making up the beam, L is the length of the beam, and I is the moment of inertia of the beam and is equal to $(w \cdot t^3)/12$ (where w is the width of the beam, as shown in FIG. 1).

Substituting into (2) both for $F_e$ from (1) and for the moment I $$\delta \approx \frac{2\varepsilon_0 L_o V^2 L^3}{d_e^2 E t^3} \tag{3}$$

Assuming that the beam 104 is naturally separated from the contact 102 by 1 μm (i.e., in the absence of $F_e$) and requiring that δ remain less than 0.5 μm (making $d_e$=0.5 μm), and taking V to be 330 V, the length L of the beam 104 to be on the order of 100 μm, and the thickness t to be on the order of 5 μm (typical dimensions for microfabricated structures), and if the elastic stiffness E is on the order of 100 GPa (a representative value for metals), (3) indicates that an overlap length $L_o$ of about 10 nm is sufficiently small so as to preclude self-actuation of the beam 104. More generally, it is expected that the overlap area A will be less than or equal to about 100 $\mu m^2$, or in some cases less than or equal to about 1 $\mu m^2$, or in other cases less than or equal to about 10 $nm^2$, depending, for example, on the material properties, separation distance, and applied voltage.

In light of the above, the contact 102 may have a contact surface 114 that has an area a that is sufficiently low so as to preclude self-actuation of the beam 104. For example, the contact surface 114 may have an area a that is less than or equal to about 100 $\mu m^2$, and in some cases less than 1 $\mu m^2$, and in other cases less than 10 $nm^2$ (for example, by forming the contact 102 from one or more nanowires). By limiting the area a of the contact 102, the opposing, oppositely-charged areas of the beam 104 and contact are limited, thereby limiting the electrostatic force $F_e$ between the two. Further, limiting the contact area between the contact 102 and beam 104 may reduce the adhesive forces that develop therebetween upon closing of the switch structure 100, thus reducing the likelihood that the switch structure will fail to open when otherwise intended (a problem sometimes referred to as "stiction").

Figure 8:
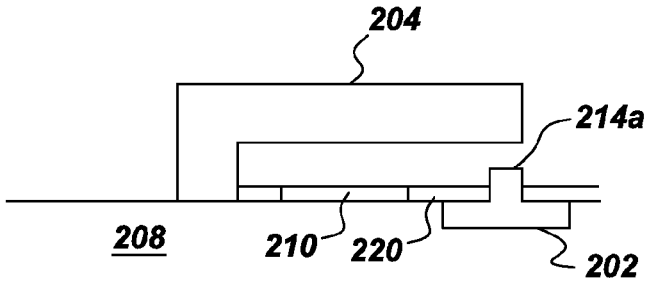
FIG. 8 is a schematic side view of a switch structure configured in accordance with another example embodiment.
Figure 9A:
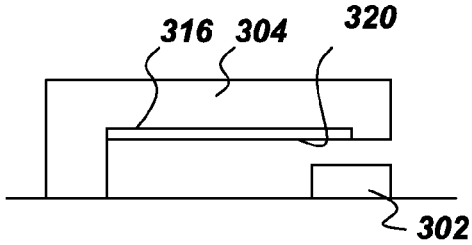
FIG. 9A is a schematic side view of a switch structure configured in accordance with yet another example embodiment, the switch structure including a beam and a contact.
Figure 9B:
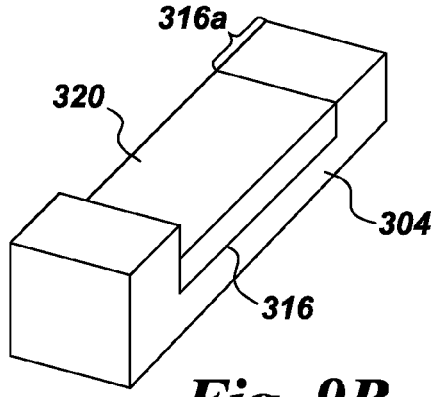
FIG. 9B is a schematic perspective view of the beam of the switch structure of FIG. 9A.
Figure 10:
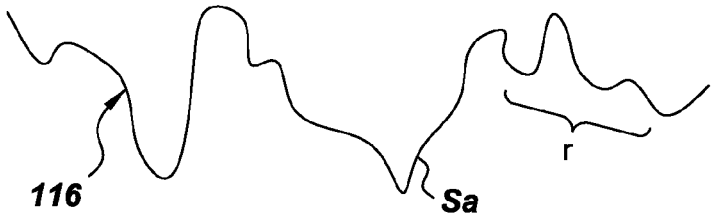
FIG. 10 is a magnified view of the area labeled 10 in FIG. 4 showing the roughness of the surface of the beam.
Figure 11:
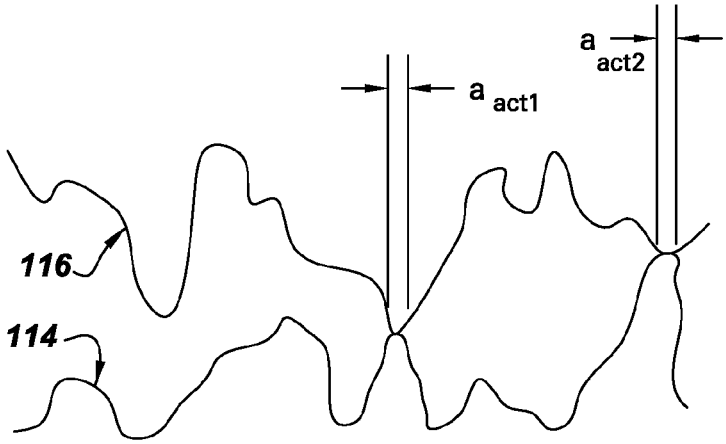
FIG. 11 is a magnified view of the area labeled 11 in FIG. 5 showing details of the contact between the surface of the beam and the surface of the contact.

Referring to FIG. 8, in another embodiment, the surface area of the contact may be relatively higher, but the "effective" contact surface area may be small. For example, a contact 202 may be disposed on a substrate 208 so as to be selectively contacted by a beam 204 under the influence of an electrostatic force established by a gate electrode 210. The contact 202 may have a surface 214 that is covered, to a significant extent, by a dielectric layer 220. A smaller effective contact surface 214*a* may be exposed through the dielectric layer 220, this smaller surface region acting as the effective surface area of the contact 202 for the purposes of establishing an electrostatic force between the beam 204 and contact (and for subsequently establishing electrical contact between the contact and beam). Referring to FIGS. 9A-B, in yet another embodiment, a beam 304 is configured to contact an associated contact 302. The surface 316 of the beam 304 can be generally covered by a dielectric layer 320, such that only a small effective contact surface 316*a* is presented by the beam for establishing electrical contact with the contact 302.

Overall, the effective contact surface area can be configured such that an electrostatic force between the contact and the conductive element is less than that required to bring the two into contact. However, as the effective contact area is reduced, it is expected that the resistance associated with the beam-contact interface will proportionally increase, and conventional wisdom indicates that a lower limit on the effective area is established by the minimum electrical resistance that can be tolerated by the system. For example, increased resistance can lead to unacceptably high levels of resistive heating and power dissipation. Further, it might be expected that the resistance-dictated lower limit on effective contact surface area would preclude, for some applications (e.g., for very high stand-off voltages, high operating currents (say, greater than 1-10 mA), and very small separation distances) reductions in effective contact surface area sufficient to adequately modulate $F_e$ so as to avoid switch closing due to self-actuation.

Applicants have observed, however, that reductions in the effective contact surface area between the beam 104 (FIG. 1) and the contact 102 (FIG. 1) do not result in proportional increases in the resistance associated with the beam-contact interface (where this interface has a metal on one or both sides thereof), but instead result in smaller than expected increases in resistance. As such, effective contact surface area for metal surfaces may be reduced without significantly increasing resistance. Further, Applicants have observed that the effective resistance of a single switch structure having a metallic effective contact surface area of 100 $\mu m^2$ presents a higher actual resistance than that for 100 parallel switch structures each having a metallic effective contact surface area of 1 $\mu m^2$, which result would otherwise not be expected from simple electronic theory.

While not wishing to be bound to any particular theory, Applicants postulate that the relationship between effective contact surface area and resistance of the contact interface may relate to the nature of contact between real (rather than idealized) surfaces. Specifically, referring to FIGS. 4, 5, 10, and 11, while surfaces (e.g., 114 and 116) are often schematically depicted as planes, real surfaces, and especially surfaces formed through conventional microfabrication techniques such as electroplating, vapor deposition, and wet and/or dry etching, often include micrometer- and nanometer-scale roughness r, as well as surface asperities sa. When two real surfaces are brought into contact (e.g., as for 114 and 116 of FIG. 5), contact is expected to occur at discrete locations dictated by the relief of the contacting surfaces, with surface asperities being expected to be more likely to first contact an opposing surface.

The nominal dimensions of the beam 104 and contact 102 serve to define an effective contact surface area $a_{eff}$. However, the actual contact surface area $a_a$, (i.e., the total area over which physical contact is established) is much lower and is equal to the aggregate of all of the individual contact points ($a_{act}=a_{act1}+a_{act2}$ . . . ). As the effective contact area is increased, so is the likelihood that an ever-larger asperity will be found within the contact area (up to a limit), thus leading to preferential contact at those larger asperities while inhibiting contact at other, less prominent locations.

From Equation (3), it is clear that the amount of deflection δ that the beam 104 experiences for a given standoff voltage V can be modulated in ways other than modifying the area A over which the beam opposes the associated contact 102. For example, the deflection δ can be reduced by increasing the resistance to deformation of the beam 104, either by increasing the elastic modulus E of the material(s) making up the beam or by increasing the bending moment of inertia I of the beam (for example, by increasing the thickness of the beam). However, increasing the resistance of the beam 104 to bending deformation may lead to a corresponding increase in the magnitude of the force required to intentionally deform the beam into contact with the contact 102.

Figure 12A:
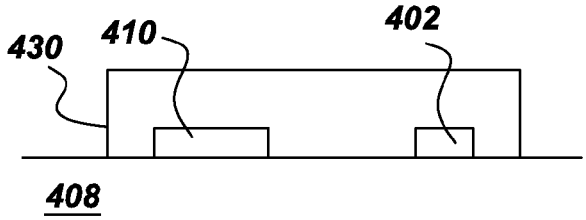
FIGS. 12A-E are schematic side view representing a process for fabricating a switch structure configured in accordance with an example embodiment.
Figure 12B:
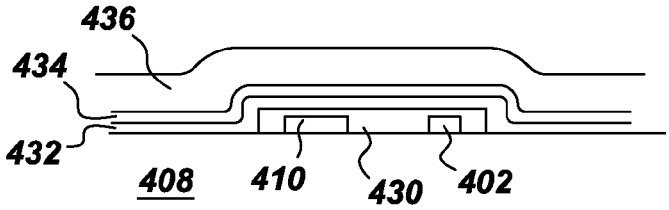
Figure 12C:
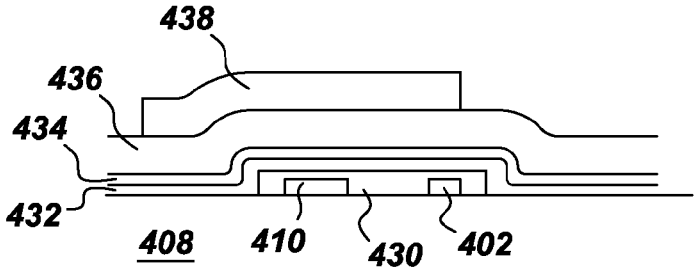
Figure 12D:
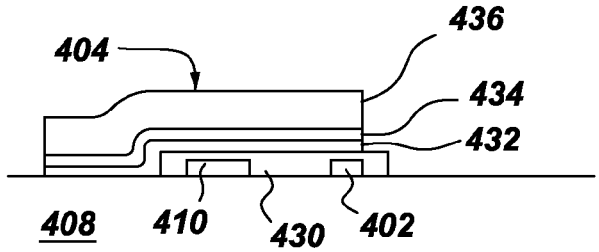
Figure 12E:
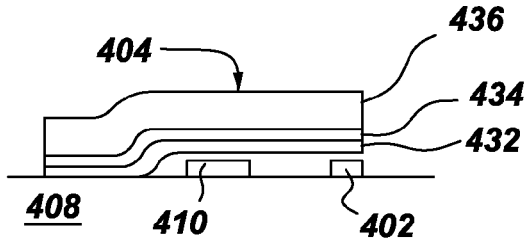

As mentioned above, switch structures as described above, such as the switch structure 100 of FIG. 1, can be fabricated on substrates using conventional microfabrication techniques. For example, referring to FIGS. 12A-E, therein is shown a schematic representation of a fabrication process for producing a switch structure configured in accordance with an example embodiment. First, a substrate 408 can be provided with an electrode 410 and a contact 402 disposed thereon. Silicon dioxide 430 can then be deposited, for example, by vapor deposition, and patterned so as to encapsulate the electrode 410 and contact 402 (FIG. 12A). A thin adhesion layer 432 (e.g., titanium), a seed layer 434 (e.g., gold), and a metal layer 436 (e.g., gold) can then be deposited via electroplating and/or vapor deposition (FIG. 12B). Photoresist 438 could then be applied and patterned using conventional photolithography (FIG. 12C), after which the metal, seed, and adhesion layers 436, 434, 432 could be etched to form a beam 404 and the photoresist subsequently removed (FIG. 12D). Finally, the silicon dioxide 430 supporting the beam 404 and encapsulating the electrode 410 and contact 402 could be removed. Thereafter, the beam 404 could be enclosed by a protective cap.

While only certain features of the invention have been illustrated and described herein, many modifications and changes will occur to those skilled in the art. For example, all of the switch structures described above have included a cantilevered beam configured to be deformed from a non-contacting position into a contacting position. However, other embodiments may include a conductive element configured to move between non-contacting and contacting positions without being significantly deformed. For example, the conductive element may couple to a resilient hinge structure. Further, for conductive elements that do undergo deformation, it is not necessary that the conductive element includes a cantilevered beam, but instead could include, for example, a doubly supported beam or a flexible membrane. Also, while the above described embodiments included a load power source that was connected to the beam/conductive element and a load connected to the associated contact, there is no requirement for this arrangement, and the load power source could be connected to the contact. Finally, there are a variety of configurations and geometries possible for the contact 102 (FIG. 1), including, for example, a bump, an array of nanowires, and/or a conductive pad embedded in a more rigid, non-conductive substrate. It is, therefore, to be understood that the appended claims are intended to cover all such modifications and changes as fall within the true spirit of the invention.

What is claimed:

1. A device comprising:

a contact; and a conductive element configured to be selectively moveable between a non-contacting position in which said conductive element is separated from said contact and a contacting position in which said conductive element contacts and establishes electrical communication with said contact, wherein, when said conductive element is disposed in the non-contacting position, said contact and said conductive element are configured to support an electric field therebetween with a magnitude of greater than 320 V $\mu m^{-1}$.

2. The device of claim 1, wherein, when said conductive element is disposed in the non-contacting position, said contact and said conductive element are configured to be held at a potential difference of at least about 330 V.

3. The device of claim 1, wherein, when said conductive element is disposed in the non-contacting position, said contact and said conductive element are configured to be separated by a distance that is less than or about equal to 4 μm.

4. The device of claim 1, wherein said conductive element has a surface area-to-volume ratio that is greater than or equal to $10^3$ $m^{-1}$.

5. The device of claim 1, wherein said conductive element is separated from said contact by a distance that is less than or equal to about 1 μm when in the non-contacting position.

6. The device of claim 1, wherein said conductive element is configured to undergo deformation when moving between the contacting and non-contacting positions.

7. The device of claim 1, wherein said conductive element includes a cantilever.

8. The device of claim 1, wherein said contact and said conductive element are part of a microelectromechanical device.

9. The device of claim 1, further comprising a power source in electrical communication with at least one of said contact or said conductive element and configured to supply a voltage of at least about 330 V.

10. The device of claim 1, wherein said conductive element is configured to undergo deformation when moving between the contacting and non-contacting positions, and wherein at least one of said contact or said conductive element has an effective contact surface area configured such that an electrostatic force between said contact and said conductive element when said conductive element is in the non-contacting position is less than a force required to bring said conductive element and said contact into contact.

11. The device of claim 1, wherein said contact and said conductive element are configured to limit current therebetween to about 1 μA or less when said conductive element is disposed in the non-contacting position.

12. The device of claim 1, wherein, when said conductive element is disposed in the non-contacting position, said contact and said conductive element are configured to be held at a potential difference that oscillates with an amplitude of at least about 330 V and with a frequency of less than or equal to about 40 GHz.

13. The device of claim 1, wherein, when said conductive element is disposed in the non-contacting position, said contact and said conductive element are configured to be held at a potential difference of at least about 330 V for a time of at least about 1 μs.

14. The device of claim 1, further comprising a substrate, and wherein said contact and said conductive element are disposed on said substrate.

15. The device of claim 1, wherein at least one of said contact or said conductive element has an effective contact surface area that is less than or equal to about 100 $\mu m^2$.

16. The device of claim 15, further comprising a power source in electrical communication with at least one of said contact or said conductive element and configured to supply a current of at least about 1 mA when said conductive element is disposed in the contacting position.

17. A device comprising:

a contact;

a conductive element configured to be selectively moveable between a non-contacting position in which said conductive element is separated from said contact and a contacting position in which said conductive element contacts and establishes electrical communication with said contact; and a power source in electrical communication with and configured to supply a voltage to at least one of said contact or said conductive element, wherein, when said conductive element is disposed in the non-contacting position, said power source is configured to supply a voltage sufficient to establish an electric field between said contact and said conductive element with a magnitude of greater than 320 V $\mu m^{-1}$.

18. The device of claim 17, wherein said power source is configured to supply a voltage of at least about 330 V.

19. The device of claim 17, wherein, when said conductive element is disposed in the non-contacting position, said contact and said conductive element are configured to be separated by a distance that is less than or about equal to 4 μm.

20. The device of claim 17, wherein said conductive element has a surface area-to-volume ratio that is greater than or equal to $10^3$ $m^{-1}$.

21. The device of claim 17, wherein said conductive element is separated from said contact by a distance that is less than or equal to about 1 μm when in the non-contacting position.

22. The device of claim 17, wherein said conductive element is configured to undergo deformation when moving between the contacting and non-contacting positions.

23. The device of claim 17, wherein said conductive element includes a cantilever.

24. The device of claim 17, wherein said contact and said conductive element are part of a microelectromechanical device.

25. The device of claim 17, wherein said conductive element is configured to undergo deformation when moving between the contacting and non-contacting positions, and wherein at least one of said contact or said conductive element has an effective contact surface area configured such that an electrostatic force between said contact and said conductive element when said conductive element is in the non-contacting position is less than a force required to bring said conductive element and said contact into contact.

26. The device of claim 17, wherein said contact and said conductive element are configured to limit current therebetween to about 1 μA or less when said conductive element is disposed in the non-contacting position.

27. The device of claim 17, wherein, when said conductive element is disposed in the non-contacting position, said contact and said conductive element are configured to be held at a potential difference that oscillates with an amplitude of at least about 330 V and with a frequency of less than or equal to about 40 GHz.

28. The device of claim 17, wherein, when said conductive element is disposed in the non-contacting position, said contact and said conductive element are configured to be held at a potential difference of at least about 330 V for a time of at least about 1 μs.

29. The device of claim 17, further comprising a substrate, and wherein said contact and said conductive element are disposed on said substrate.

30. The device of claim 17, wherein at least one of said contact or said conductive element has an effective contact surface area that is less than or equal to about 100 $\mu m^2$.

31. The device of claim 30, further comprising a current source in electrical communication with at least one of said contact or said conductive element and configured to supply a current of at least about 1 mA when said conductive element is disposed in the contacting position.

32. A device comprising:

a contact; and a conductive element configured to be selectively moveable between a non-contacting position in which said conductive element is separated from said contact and a contacting position in which said conductive element contacts and establishes electrical communication with said contact, wherein, when said conductive element is disposed in the non-contacting position, said contact and said conductive element are configured to be held at a potential difference of at least about 330 V.

33. The device of claim 32, wherein, when said conductive element is disposed in the non-contacting position, said contact and said conductive element are configured to be separated by a distance that is less than or about equal to 4 μm.

34. The device of claim 32, wherein said conductive element has a surface area-to-volume ratio that is greater than or equal to $10^3$ $m^{-1}$.

35. The device of claim 32, wherein said conductive element is separated from said contact by a distance that is less than or equal to about 1 μm when in the non-contacting position.

36. The device of claim 32, wherein said conductive element is configured to undergo deformation when moving between the contacting and non-contacting positions.

37. The device of claim 32, wherein said conductive element includes a cantilever.

38. The device of claim 32, wherein said contact and said conductive element are part of a microelectromechanical device.

39. The device of claim 32, further comprising a power source in electrical communication with at least one of said contact or said conductive element and configured to supply a voltage of at least about 330 V.

40. The device of claim 32, wherein said conductive element is configured to undergo deformation when moving between the contacting and non-contacting positions, and wherein at least one of said contact or said conductive element has an effective contact surface area configured such that an electrostatic force between said contact and said conductive element when said conductive element is in the non-contacting position is less than a force required to bring said conductive element and said contact into contact.

41. The device of claim 32, wherein said contact and said conductive element are configured to limit current therebetween to about 1 μA or less when said conductive element is disposed in the non-contacting position.

42. The device of claim 32, wherein, when said conductive element is disposed in the non-contacting position, said contact and said conductive element are configured to be held at a potential difference that oscillates with an amplitude of at least about 330 V and with a frequency of less than or equal to about 40 GHz.

43. The device of claim 32, wherein, when said conductive element is disposed in the non-contacting position, said contact and said conductive element are configured to be held at a potential difference of at least about 330 V for a time of at least about 1 μs.

44. The device of claim 32, further comprising a substrate, and wherein said contact and said conductive element are disposed on said substrate.

45. The device of claim 32, wherein at least one of said contact or said conductive element has an effective contact surface area that is less than or equal to about 100 $\mu m^2$.

46. The device of claim 45, further comprising a power source in electrical communication with at least one of said contact or said conductive element and configured to supply a current of at least about 1 mA when said conductive element is disposed in the contacting position.

* * * * *

UNITED STATES PATENT AND TRADEMARK OFFICE

CERTIFICATE OF CORRECTION

PATENT NO. : 7,928,333 B2
APPLICATION NO. : 12/541321
DATED : April 19, 2011
INVENTOR(S) : Wang et al.

It is certified that error appears in the above-identified patent and that said Letters Patent is hereby corrected as shown below:

On the Title page, Item (75), under "Inventors", Line 8, after "NY (US)", insert Seventh Inventor -- Debdutt Patro, Karnataka (IN) --.

On the Title page, Item (75), under "Inventors", insert Eighth Inventor -- Vikash Kumar Sinha, Karnataka (IN) --.

On the Title page, Item (75), under "Inventors", insert Ninth Inventor -- Om Prakash, Karnataka (IN) --.

Signed and Sealed this
Twelfth Day of July, 2011

David J. Kappos

David J. Kappos
*Director of the United States Patent and Trademark Office*